US007618031B2

(12) United States Patent
Weaver et al.

(10) Patent No.: US 7,618,031 B2
(45) Date of Patent: Nov. 17, 2009

(54) MASS IMPACT CLAW BAR

(76) Inventors: Lloyd Weaver, 7223 Emerald Hights Rd., Rapid City, SD (US) 57718; Bernt Askildsen, 1507 Plateau La., Rapid City, SD (US) 57703; Lance Weaver, 3921 Mary Dr., Rapid City, SD (US) 57702

( * ) Notice: Subject to any disclaimer, the term of this patent is extended or adjusted under 35 U.S.C. 154(b) by 0 days.

(21) Appl. No.: 11/823,928

(22) Filed: Jun. 30, 2007

(65) Prior Publication Data

US 2008/0001129 A1 Jan. 3, 2008

Related U.S. Application Data

(60) Provisional application No. 60/806,462, filed on Jul. 1, 2006.

(51) Int. Cl.
*B25C 11/00* (2006.01)

(52) U.S. Cl. ..... 269/25; 269/131; 29/275

(58) Field of Classification Search ..... 254/25, 254/131; 29/254, 255, 275
See application file for complete search history.

(56) References Cited

U.S. PATENT DOCUMENTS

| | | | | |
|---|---|---|---|---|
| 4,183,503 | A | 1/1980 | Ward | |
| 4,533,116 | A | 8/1985 | Panovic | |
| 4,785,488 | A | 11/1988 | Schellas | |
| 5,322,264 | A * | 6/1994 | Giambro | 254/25 |
| 5,695,172 | A * | 12/1997 | Hreha | 254/25 |
| 5,938,177 | A | 8/1999 | Fonda | |
| 5,957,429 | A | 9/1999 | Khachatoorian | |
| 6,086,048 | A | 7/2000 | Owen | |
| 6,308,934 | B1 * | 10/2001 | Gallo | 254/25 |
| 6,644,627 | B1 | 11/2003 | Forrester | |

* cited by examiner

*Primary Examiner*—Lee D Wilson
(74) *Attorney, Agent, or Firm*—Gene R. Woodle

(57) ABSTRACT

Embodiments of a mass impact claw bar are disclosed which may be used as a pry bar or as a tool to separate articles such as trim board from wallboard. The device has a substantially vertical claw at one end and a substantially horizontal claw at the other end. Force is applied to either claw by moving a slidable mass slidably affixed to the claw bar.

4 Claims, 2 Drawing Sheets

MASS IMPACT CLAW BAR

RELATED APPLICATIONS

This application relies for priority upon the Provisional Patent Application filed by Lance Weaver, Lloyd Weaver, and Bernt Askildsen entitled Mass-impact board removing claw bar, Ser. No. 60/806,462, filed Jul. 1, 2006.

BACKGROUND OF THE INVENTION

1. Field of the Invention

The present invention relates generally to hand tools and more specifically to a mass impact claw bar which may be used as a mass impact pry bar to safely remove articles such as trim board.

2. Background Information

All around the United States and throughout the world, millions of people use various claw or pry bars on a daily basis. One common use of such tool results from a flood in a residential or commercial building which requires immediate restoration as there is a high probability of microbial or mold growth which will cause materials to deteriorate if no action is taken. One appropriate restoration procedure is to remove of lift up carpets before removing the water or humidity. Furthermore, in order to dry the inside of wet walls trim boards need to be removed so that small vent holes may be drilled to create airflow. Sufficient airflow removes humidity and prevents microbial or mold growth behind the trim and inside the wall itself. Gypsum wallboard's physical strength is significantly reduced when wet. Therefore, the restoration process of removing trim board, baseboard, and the like often causes compression damage where a tool is applied. Furthermore, large pieces of underlying gypsum wallboard my break off if the force from the tool is not applied perpendicular to the board to be removed. Consequently, many persons who specialize in such restoration avoid removing such boards to minimize the possibility of expensive gypsum wallboard repairs. However, this method of saving the wallboard usually results in poor quality restoration.

A variety of tools have been invented which attempt to solve similar problems to those relating to removing trim and similar articles from damp gypsum wallboard. The patent to Ward (U.S. Pat. No. 4,183,503; Jan. 15, 1980) discloses a one piece demolition tool and the patent to Panovic (U.S. Pat. No. 4,533,116; Aug. 6, 1985) discloses a claw hammer for driving and extracting nails. The Panovic device has a fulcrum member hinge to swing between retracted and extended positions. The patent to Schellas (U.S. Pat. No. 4,785,488; Nov. 22, 1988) discloses a lever bar adapted for performing multiple functions including: crowbar, pry bar, pickax, wedge, and the like. The patent to Khachatoorian (U.S. Pat. No. 5,957,429; Sep. 28, 1999) discloses an improved prying bar that includes an elongate shank, which has a longitudinal axis, a prying hook, and a prying chisel. The patent to Fonda (U.S. Pat. No. 5,938,177; Aug. 17, 1999) discloses a power bar device. The patent to Owen (U.S. Pat. No. 6,086,048; Jul. 11, 2000) discloses a board puller having a board cue which contacts the backside of the boards to be removed. This device uses a fulcrum with a pivot that interacts with the frame structure and a handle for providing leverage. The patent to Forrester (U.S. Pat. No. 6,644,627; Nov. 11, 2003) discloses a tool for removing deck boards.

The mass impact claw bar of the instant invention solves a number of problems relating to the removal of trim and other boards from wet or damp gypsum wallboard in a unique and original manner not exhibited in the prior art. The mass impact claw bar of the instant invention prevents damage to damp wallboard because its use does not require "prying force" against the wallboard, but uses a sliding impact mass to apply the necessary force.

The ideal mass impact claw bar should have a thin claw at one end which may easily be inserted between the objects to be levered apart. The ideal mass impact claw bar should provide a second claw at its other end which provides a second type of prying tool and also acts as a support to hold the claw bar in a substantially horizontal position when in use. The ideal mass impact claw bar should also have a sliding mass which may be used to supply the necessary force to the first claw. The ideal mass impact claw bar should also be simple, reliable, inexpensive, and easy to use.

SUMMARY OF THE INVENTION

The mass impact claw bar of the instant invention may be used to easily remove trim boards from gypsum wallboard walls without causing damage. The instant device includes a main bar which has a vertical claw at one end and a horizontal claw at the other end. These elements, the main bar, vertical claw, and horizontal claw may be made from a single piece of a material such as steel which is bent and sharpened appropriately. When the main bar is horizontal, the vertical claw is bent such that it is substantially vertical with a sharpened vertical tip at its end and the horizontal claw is bent such that it curves downward and rearward from the main bar and ends with a horizontal tip substantially parallel with the main bar. That is, with the vertical tip inserted between a wallboard and a piece of trim board, the main bar is substantially horizontal and the horizontal claw supports the main bar in the horizontal position and is capable of easily sliding along the floor or similar surface.

There is a slot which runs along the longitudinal axis of the main bar. A sliding mass may be slidably affixed within this slot and is capable of sliding along the main bar. When the mass impact claw bar is positioned as described above, the sliding mass is slid forcefully in the direction of the vertical claw. The sliding mass hits the end of the slot and this provides the force necessary to force the vertical claw down between the trim and the wallboard and separate the two.

In a second embodiment, the horizontal claw protrudes more directly rearward of the main bar and a heel protrudes downward from the end of the main bar to perform the purpose of creating a support point to slide along the floor.

The above describes the basic configuration of the mass impact claw bar of the instant invention in two embodiments. Although the device is described as being used to remove trim from wallboard, it will be understood that the device could also be used for any number of other, similar, purposes.

One of the major objects of the present invention is to provide a tool for easily separating a trim board from a wallboard without causing damage to either the trim board or the wallboard.

Another objective of the present invention to provide a device with a thin claw at one end which may easily be inserted between the objects to be levered apart.

Another objective of the present invention is to provide a second claw at its other end which provides a second type of prying tool and also acts as a support to hold the claw bar in a substantially horizontal position when in use.

Another objective of the present invention is to provide a sliding mass which may be used to supply the necessary force to the first claw.

Another objective of the present invention is to provide a mass impact claw bar which is simple, reliable, inexpensive, and easy to use.

These and other features of the invention will become apparent when taken in consideration with the following detailed description and the drawings.

DESCRIPTION OF A PREFERRED EMBODIMENT

Figure 1:
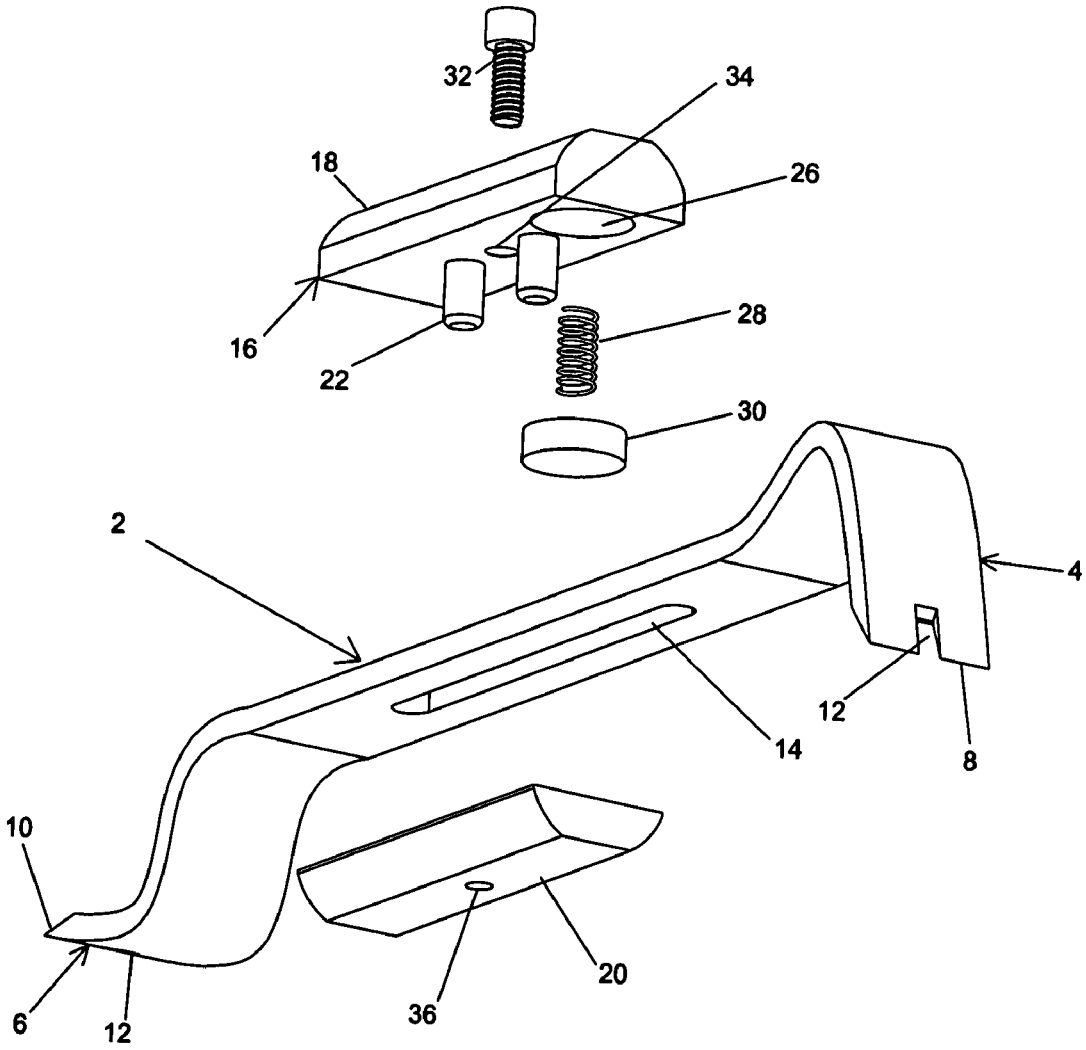
FIG. 1 is an exploded isometric view of the mass impact claw bar of the instant invention.
Figure 2:
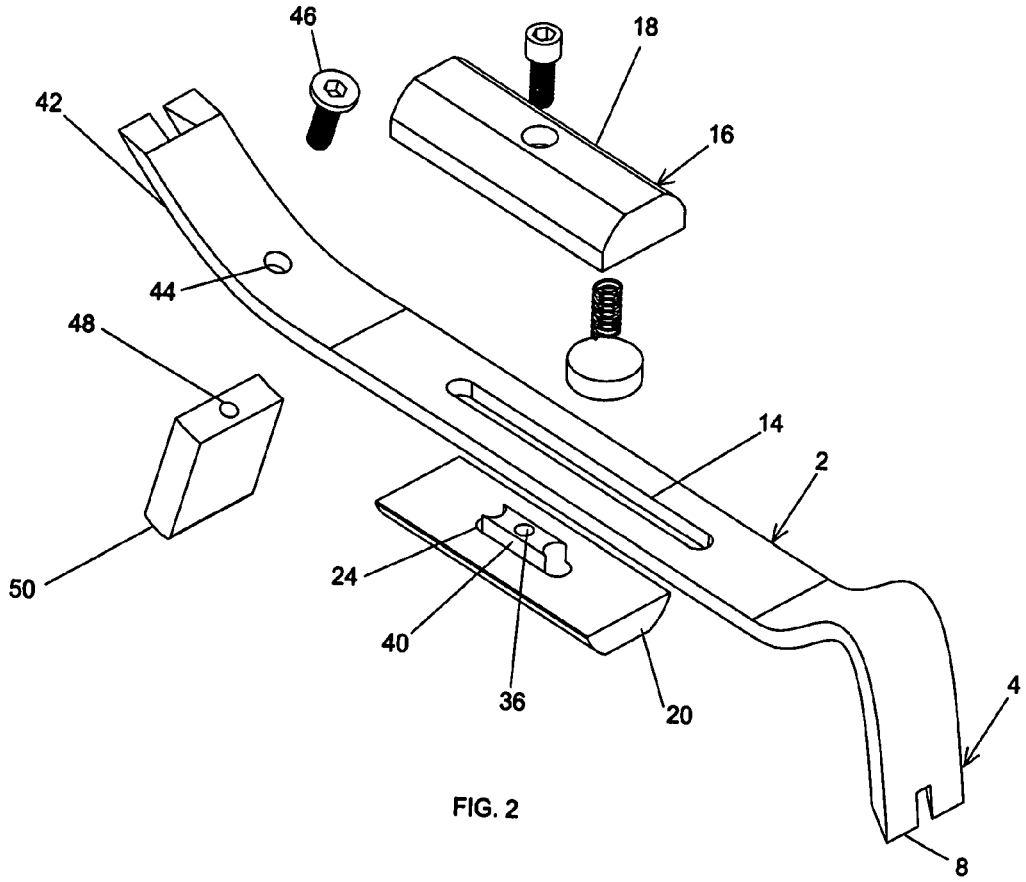
FIG. 2 is an exploded isometric view of a second embodiment of the mass impact claw bar of the instant invention.
Figure 3:
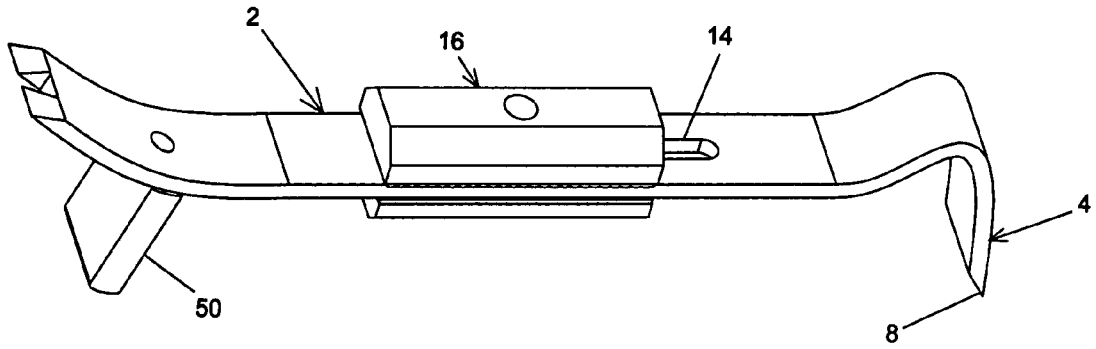
FIG. 3 is an isometric view of the second embodiment of the mass impact claw bar of the instant invention.

Referring to the drawings, FIGS. 1 through 3, there are shown two embodiments of the mass impact claw bar of the instant invention. The instant invention is shown and described below as a tool to be used to separate wall trim boards from wet gypsum wallboard without damaging the wallboard, but, without changing the spirit of the invention, the tool could be used for a wide variety of other purposes.

Now referring to FIG. 1, an exploded isometric view of the mass impact claw bar of the instant invention is shown. The device includes a main bar 2 which is generally straight. At one end of the main bar 2 (referred to as the forward end) is a vertical claw 4. At the other end of said main bar 2 is a horizontal claw 6. The vertical claw 4 ends in a sharpened vertical tip 8 and the horizontal claw 6 ends in a sharpened horizontal tip 10. Both the vertical tip 8 and the horizontal tip 10 include a nail puller 12. In the preferred embodiment of the invention, all the foregoing elements may be formed from a single steel bar bent and sharpened to the appropriate shape. Said vertical claw 4 is bent such that it is substantially perpendicular to said main bar 2. However, said vertical claw 4 is angled such that the forward most portion of said vertical claw 4 is slightly further forward than the rest of said vertical claw 4. Said horizontal claw 6 is bent downward and rearward such that when said vertical tip 8 is positioned at the top of the seam between a conventional piece of trim and a piece of wallboard and the bottom of said horizontal claw 6 rests upon the floor (or similar surface), said main bar 2 is substantially horizontal. There is a slot 14 through said main bar 2 along the longitudinal axis of said main bar 2.

Still referring to FIG. 1, there is a sliding mass 16 which is slidably affixed within said slot 14. The sliding mass 16 is comprised of a top mass 18 and a bottom mass 20. A pair of top mass pins 22 protrude downward from the longitudinal axis of the top mass 18 and slide within said slot 14. The top mass pins 22 engage a pair of complimentary centering holes 24 (see FIG. 2) in the bottom mass 20. There is a recess 26 in the bottom surface of said top mass 18. A spring 28 and a stop 30 fit within the recess 26. A bolt 32 fits through a bolt hole 34 through the center of said top mass 18 and engages a threaded hole 36 in the center of said bottom mass 20. When the bolt 32 is tightened, said top mass 18 is secured to said bottom mass 20 and said sliding mass 16 may slide freely within said slot 14. The spring 28 tends to press the stop 30 against the top surface of said main bar 2, which tends to prevent said sliding mass 16 from moving until force is applied to it.

Referring now to FIG. 2, an exploded isometric view of a second embodiment of the mass impact claw bar of the instant invention is shown. This view shows a second embodiment of the instant invention, but all of the elements except for said horizontal claw 6 are the same. This view better shows the centering holes 24 into which said top mass pins 22 (see FIG. 1) are inserted. This view also shows a riser 40 which protrudes upward from the center of said bottom mass 20 and which fits between said top mass pins 22 when said top mass 18 is affixed to said bottom mass 20. The riser 40 also fits within said slot 14 and acts to insure that said sliding mass 16 slides smoothly within said slot 14. As may be seen said sliding mass 16 may slide along the length of said slot 14 until one of said top mass pins 22 hits either the forward end or the rearward end of said slot 14.

Still referring to FIG. 2, the rearward end of the mass impact claw bar of the instant invention is different in this embodiment than that described above. Rather than being bent downward and rearward from said main bar 2 as said horizontal claw 12, a second horizontal claw 42 is configured such that it starts directly rearward from the rearward end of said main bar 2 and then curves slightly upward. A claw hole 44 is provided in the center of the second horizontal claw 42 at the point where is starts to curve upward. A heal 50 is provided which includes a second threaded hole 48 on its top surface. The heal 50 is secured by a second bolt 46 which passes through the claw hole 44 and screws into the second threaded hole 48. Said heal 50 is configured such that when said vertical claw 4 is inserted into the seam between the top of a piece of trim and a piece of wallboard and the bottom of said heal 50 rests on the floor or similar surface, said main bar 2 is substantially horizontal.

Referring now to FIG. 3, an isometric view of the second embodiment of the mass impact claw bar of the instant invention is shown. This view shows the tool of the instant invention as it would look when fully assembled. It should be understood that the bottom of said heal 50 performs the same function as the bottom portion of said horizontal claw 6 as described in the first embodiment of the invention. In operation, said vertical tip 8 is inserted between the top of a piece of trim board and a piece of wallboard. The bottom of said heal 50 (or said horizontal claw 6) rest upon and is capable of sliding upon the floor. Said sliding mass 16 is moved rapidly from a position near the rearward portion of said slot 14 toward the front of said slot 14. The forward most of said top mass pins 22 hits the forward end of said slot 14. The energy of said sliding mass 16 is transferred from said main bar 2 to said vertical tip 8 which acts to separate the piece of trim board from the piece of wallboard. Because the force is applied vertically and not perpendicular to the wallboard, the wallboard is not damaged even though it may be weakened by being damp. It will be understood that the tool of the instant invention could be used for a variety of other purposes and said sliding mass 16 could be moved in the opposite direction and said horizontal tip 6 also used for a variety of prying or separating purposes.

All elements of the mass impact claw bar are made of steel except for those described below, but other material having similar strength and stiffness could be used. Said bolt 32, said spring 28, and said second bolt 46 are conventional. Said stop 30 is made from any stiff plastic, but could be made from metal. Said sliding mass 16 could be made from a dense plastic or composite material as long as it had sufficient mass to function properly.

While preferred embodiments of this invention have been shown and described above, it will be apparent to those skilled in the art that various modifications may be made in these embodiments without departing from the spirit of the present invention.

We claim:

1. A mass impact claw bar comprising:

(1) a handle having a forward end and a rearward end and having a slot located between the forward end and the rearward end;

(2) a forward claw affixed to the forward end of the handle, the forward claw having a sharpened end and the end of said forward claw being substantially perpendicular to said handle; and (3) a slidable mass being slidably affixed to said handle such that the slidable mass may be slid either forward or rearward along said handle and the slidable mass having at least one pin which engages the slot in said handle such that said slidable mass is stopped when the pin encounters either the forward end or the rearward end of said slot;

whereby the mass impact claw bar may be used to pry two items apart by inserting the sharpened end of said forward claw between the two items and moving said slidable mass either forward or rearward until said pin in said slidable mass hits either the forward end or the rearward end of said slot in said handle and the momentum of said slidable mass it transferred to said sharpened end of said forward claw.

2. The mass impact claw bar of claim 1 in which there is a rearward claw having a sharpened end affixed to the rearward end of said handle and in which the rearward end of the rearward claw is substantially parallel to said handle.

3. The mass impact claw bar of claim 2 in which the rearward claw angles downward and rearward such that when the sharpened end of said forward claw is positioned between two items to be pried apart the mass impact claw bar is supported by the lowest point of said rearward claw and said handle is substantially perpendicular to the plane of the two items to be pried apart.

4. A mass impact claw bar comprising:

(1) a handle having a forward end and a rearward end;

(2) a forward claw affixed to the forward end of the handle, the forward claw having a sharpened end and the end of said forward claw being substantially perpendicular to said handle;

(3) a slidable mass being slidably affixed to said handle such that the slidable mass may be slid either forward or rearward along said handle; and (4) stop means capable of stopping the movement of said slidable mass along said handle both near the forward end of said handle and near the rearward end of said handle;

(5) a rearward claw affixed to the rearward end of said handle, the rearward claw having a sharpened end and the end of said rearward claw being substantially parallel to and aligned with said handle; and (6) a heal affixed near the rearward end of said handle and projecting downward such that when the sharpened end of said forward claw is positioned between two items to be pried apart the mass impact claw bar is supported by the lowest point of the heal and said handle is substantially perpendicular to the longitudinal axis of the two items to be pried apart;

whereby the mass impact claw bar may be used to pry two items apart by inserting the sharpened end of said forward claw between the two items and moving said slidable mass either forward or rearward until said slidable mass hits a stop means and the momentum of said slidable mass it transferred to said sharpened end of said forward claw.

* * * * *